US008012067B2

(12) United States Patent
Joannou

(10) Patent No.: US 8,012,067 B2
(45) Date of Patent: Sep. 6, 2011

(54) WHOLE BODY VIBRATOR (II)

(76) Inventor: Constantinos Joannou, Ottawa (CA)

( * ) Notice: Subject to any disclaimer, the term of this patent is extended or adjusted under 35 U.S.C. 154(b) by 0 days.

(21) Appl. No.: 12/550,458

(22) Filed: Aug. 31, 2009

(65) Prior Publication Data

US 2010/0049105 A1 Feb. 25, 2010

Related U.S. Application Data

(63) Continuation-in-part of application No. 12/163,183, filed on Jun. 27, 2008, now Pat. No. 7,594,878.

(51) Int. Cl.
*A63B 22/02* (2006.01)

(52) U.S. Cl. ..... 482/54; 601/89

(58) Field of Classification Search ..... 482/51, 482/54, 68, 79, 80, 142, 148; 601/27, 29–31, 601/49, 51, 53, 67–71, 85, 89–91, 98–100, 601/115, 116, 118

See application file for complete search history.

(56) References Cited

U.S. PATENT DOCUMENTS

| | | | | | |
|---|---|---|---|---|---|
| 1,570,528 | A | * | 1/1926 | Schaffner | 280/229 |
| 3,152,813 | A | * | 10/1964 | Brown | 280/220 |
| 4,073,500 | A | * | 2/1978 | Campeau | 280/87.041 |
| 4,518,176 | A | * | 5/1985 | Hegedus | 280/229 |
| 4,943,072 | A | * | 7/1990 | Henig | 280/11.215 |
| 6,011,491 | A | * | 1/2000 | Goetzl | 340/870.3 |

* cited by examiner

*Primary Examiner* — Loan Thanh
*Assistant Examiner* — Tam Nguyen
(74) *Attorney, Agent, or Firm* — David J French

(57) ABSTRACT

This invention relates to a whole body vibrator platform which is attachable to a treadmill. The treadmill belt provides the power to move the platform, translating the horizontal, linear, belt movement into vertical oscillations through one or more eccentrically mounted rollers which support the platform. A person standing on the vibrator platform experiences a vertical vibration at frequencies established by the linear velocity of the treadmill belt.

20 Claims, 13 Drawing Sheets

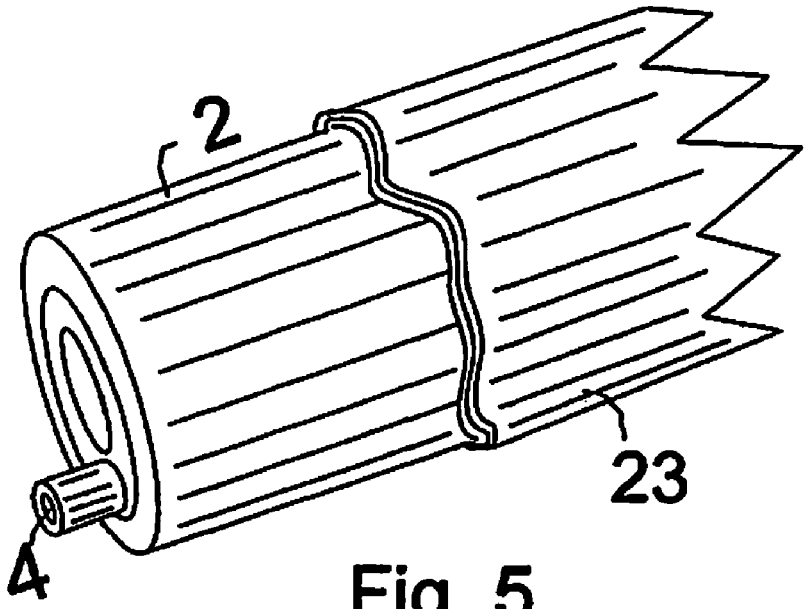
Fig. 5
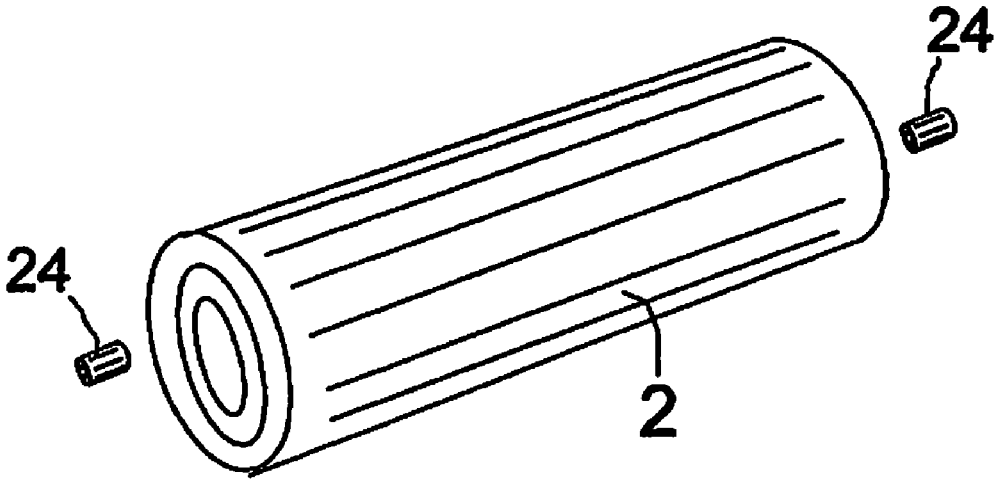
Fig, 6

38
37
44
44

6
37
41
44
42
40
46
45
39
37
41
44
43
30

WHOLE BODY VIBRATOR (II)

This application is a continuation-in-part of application Ser. No. 12/163,183 filed on Jun. 27, 2008 now U.S. Pat. No. 7,594,878.

FIELD OF THE INVENTION

This invention relates to an accessory to a treadmill which enables the treadmill to be converted into a whole body vibrator.

BACKGROUND OF THE INVENTION

Recently, a product appeared on the market which was originally used by the Russians to rehabilitate their astronauts after being out in space for many days. This product or device is a machine that a person can stand on and it effects vibration on the whole body. The benefit of this is to loosen up joints and to improve blood and lymphatic circulation. Another claim is that by using the device, one gets the benefit of exercise without doing actual exercise. Whole body vibrator machines are relatively expensive. They cost anywhere from $4,000 to as much as $14,000 depending on the complexity of the device.

There is also a very inexpensive machine that consists only of a platform that is suspended in rubber cushions and the platform is vibrated only in a horizontal cyclical motion. This machine does not produce vibrations in a person's whole skeleton. It only vibrates the legs in a circular mode.

It would be desirable to provide a device which is very simple and it effects whole body vibration just like the expensive ones on the market but at a fraction of the cost. This invention has that objective.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention, in one of its broader terms, is a mechanical device which can be attached to a treadmill where it converts the linear movement of the treadmill belt to an oscillating vertical motion and at the same time, circular motion. As such, the invention serves as a whole body vibrator. It includes a cylinder which has an eccentrically located shaft through it. The eccentric shaft extends beyond the ends of the cylinder. At the two opposite ends of the shaft there are bearings which are attached to a platform for a person to stand on. The platform is attached to the frame of the treadmill via a link, preferably a flexible bar, so as to localize the platform on the treadmill surface.

More particularly, the invention provides a whole body vibrator for attachment to a treadmill having a moving belt whereby the linear motion of the belt of the treadmill is converted to a vibratory motion comprising:

a platform on which a user may stand;

a roller for contacting the belt of a treadmill wherein the roller is eccentrically supported through bearings carried by said platform; and a linkage connecting the platform to the treadmill to localize the platform on the belt and restrict longitudinal movement of the platform with respect to the belt, whereby the advancement of the treadmill belt causes the platform to effect an oscillating motion suited to provide a user, whose feet are positioned on the platform, with a whole body vibrator experience.

According to one variant of the invention the roller is carried by an eccentrically positioned axle shaft extending through the roller to provide protruding ends, said ends being supported by the bearings. According to another variant of the invention the roller has outer ends and eccentrically positioned shaft ends protruding from each of the respective ends of the roller to provide roller protrusions which are coupled to the platform through bearings carried by the platform.

The linkage which positions or localizes the platform on the belt is preferably longitudinally stiff but maybe laterally flexible. In order to better distribute the weight of the platform and corresponding pressure on the surface of the belt and to reduce noise, a resilient layer may be provided that extends over at least a portion of the surface of the roller that contacts the belt In order to provide a user with a display that includes a presentation corresponding to the frequency of oscillation of the platform, the whole body vibrator of the invention may include:

a magnetic element mounted on the roller, a sensor for detecting the presence of the magnetic element mounted on the platform at a position to detect the magnetic element as it rotates past the sensor, a display controller connected to the sensor for generating a signal proportional to the rotational velocity of the roller, and a display connected to the display controller to receive the signal for providing an indication of the rotational velocity of the roller The magnetic element may either be a piece of magnetic material, such as iron, or may be made magnetized material, such as magnetized iron or other permanently magnetized substance. The sensor may be a whole sensor or, conveniently when used in conjunction with a magnetized material, a simple coil that provides an electric pulse as the magnetized magnetic element passes by the sensor. Simple circuitry in the controller well-known to persons of the art can be constructed to convert this signal into a readout of the speed of the roller to the user.

The foregoing summarizes the principal features of the invention and some of its optional aspects. The invention may be further understood by the description of the preferred embodiments, in conjunction with the drawings, which now follow.

Wherever ranges of values are referenced within this specification, sub-ranges therein are intended to be included within the scope of the invention unless otherwise indicated. Where characteristics are attributed to one or another variant of the invention, unless otherwise indicated, such characteristics are intended to apply to all other variants of the invention where such characteristics are appropriate or compatible with such other variants.

BRIEF DESCRIPTION OF THE DRAWINGS

FIG. 5 shows the roller with a resilient layer over its outer surface.

FIG. 6 shows the roller which, instead of having a single shaft through it, it has two short shafts attached to each end of the roller.

DESCRIPTION OF PREFERRED EMBODIMENTS

Figure 1:
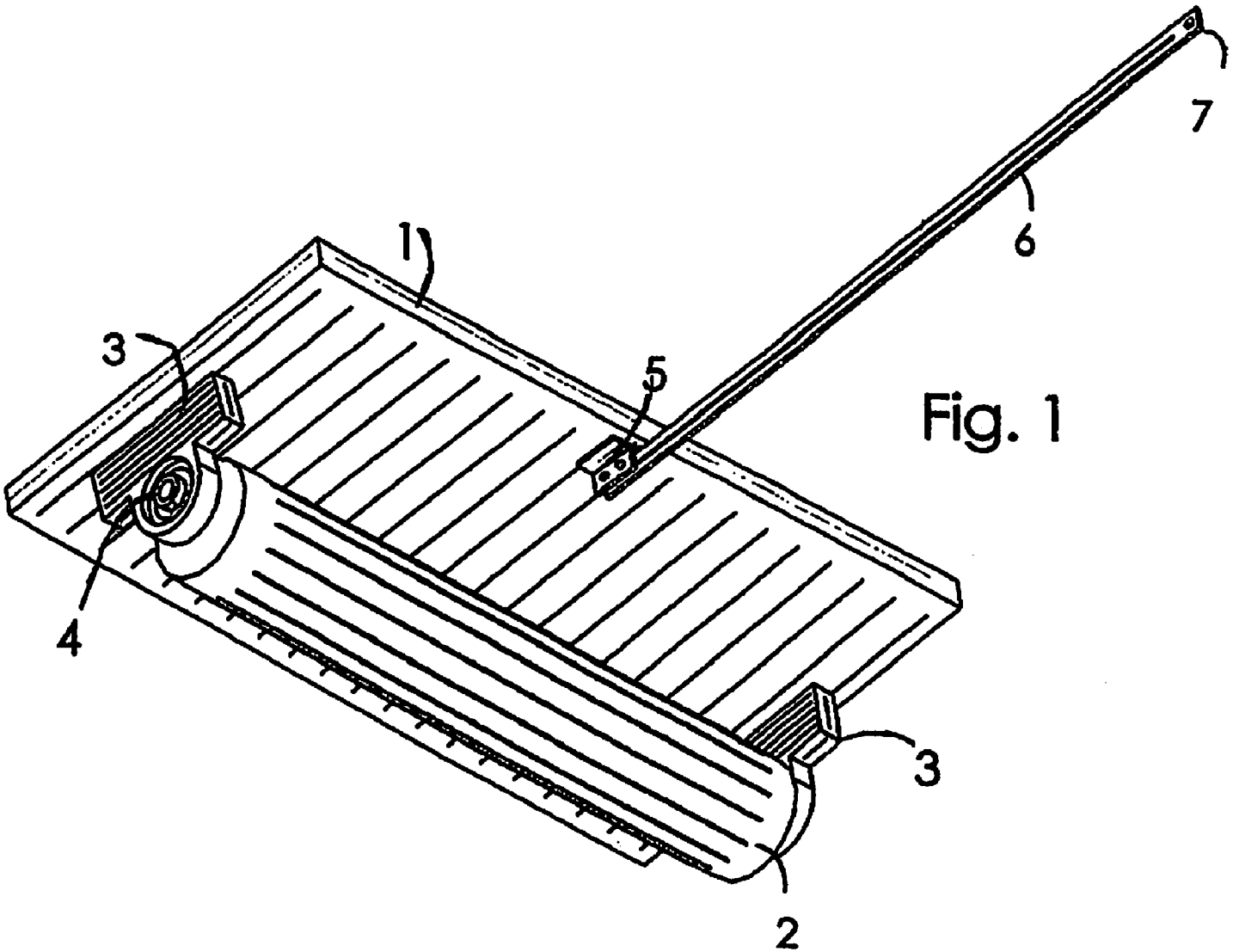
FIG. 1 shows the whole body vibrator device of the invention which is attachable to a treadmill.
Figure 3:
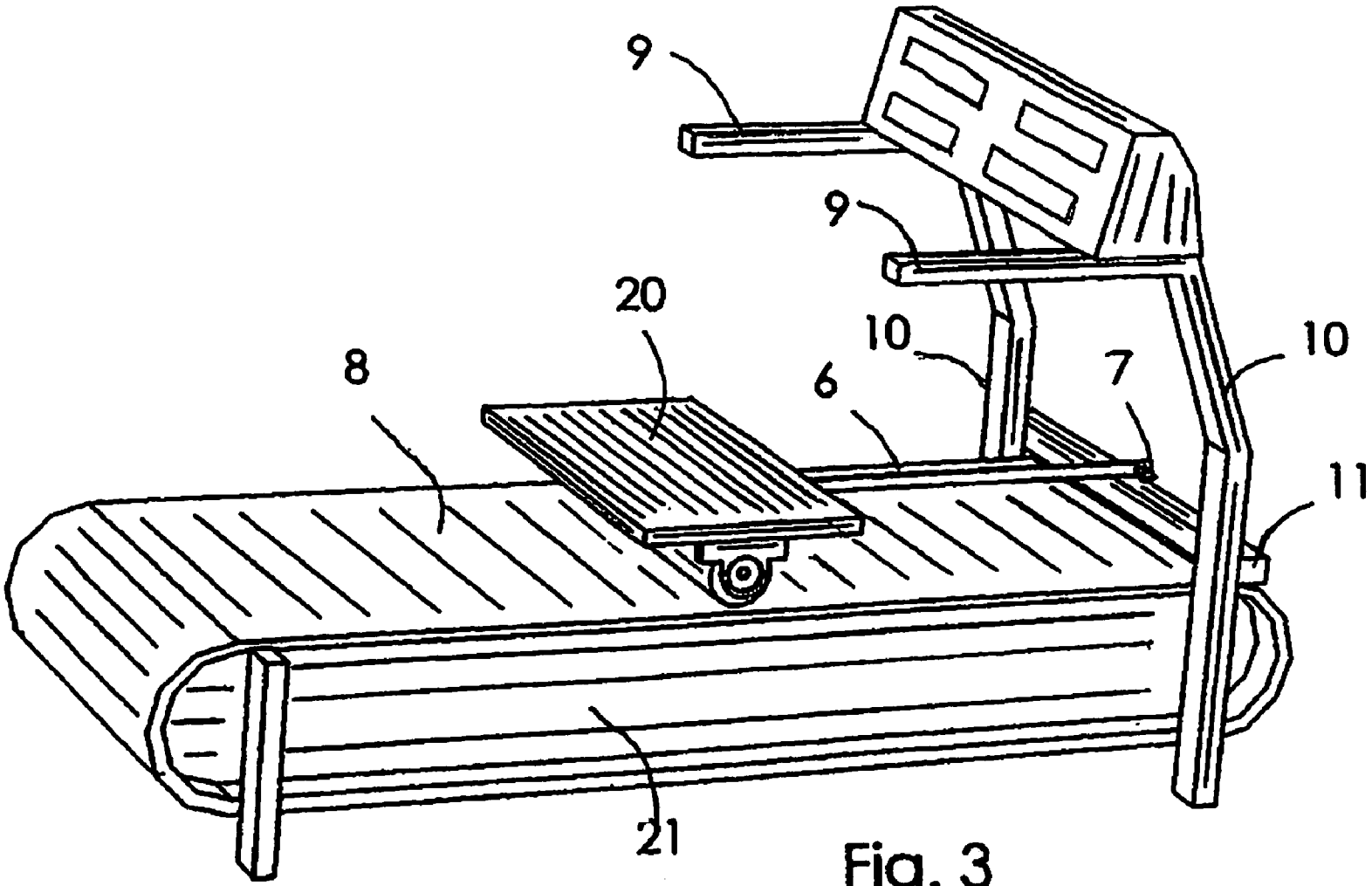
FIG. 3 shows the whole body vibrator of FIG. 1 attached to a treadmill.
Figure 7:
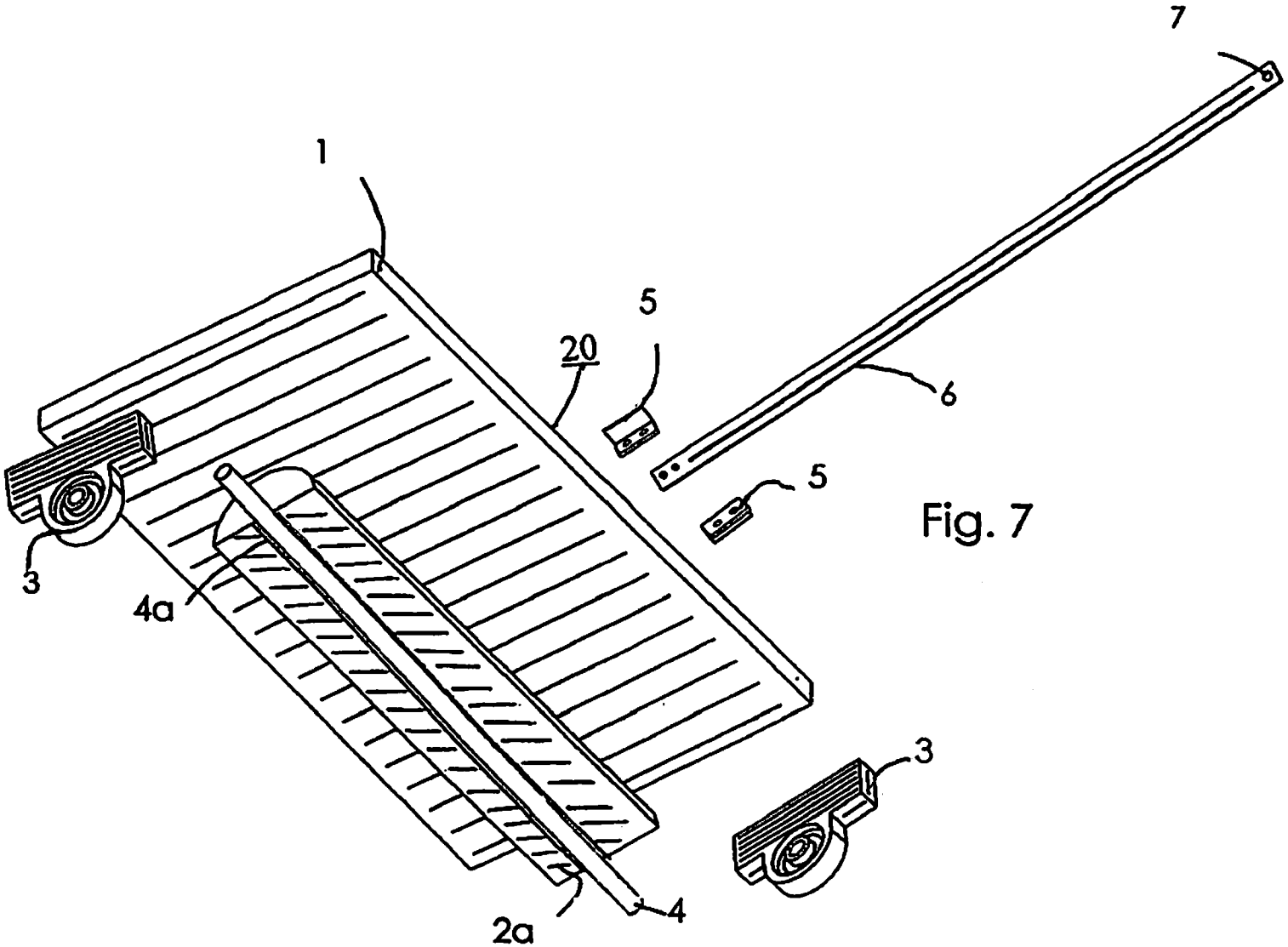
FIG. 7 is a sectional view of the roller showing the shaft through it where the roller itself is not fixed to the shaft but the roller is free to rotate around the shaft.

The whole body vibrator as best seen in FIG. 1, includes a platform 1 provided with two bearing housings 3 (shown in the form of pillow blocks) fixed to its underside. These bearing housings 3 support an axle shaft 4 that carries a roller 2. The roller 2 may be either fixed in its connection to the axle shaft 4 or it may be free to rotate with respect to the shaft 4 (see FIG. 7, bearing 4*a*). In the former case, such bearings are fitted into the bearing housings 3. In the latter case, the bearing 4*a* (FIG. 7) in the roller, will permit rotation between the roller and the shaft 4. The bearing housings 3 need not incorporate true bearings but shaft 4 is fixed in the bearing housings. In either case the roller 2 is eccentrically positioned with respect to the shaft 4 and is dimensioned such that it may easily contact belt 8 of a treadmill 21 when the device is positioned thereon, as seen in FIG. 3.

While the roller 2 is shown with a single shaft with ends protruding from each end of the roller, instead, the outer ends of the roller may be provided with two shaft ends 24 (FIG. 6). Such shaft ends 24 have inner portions which are solidly embedded within the interior the roller 2.

Figure 9:
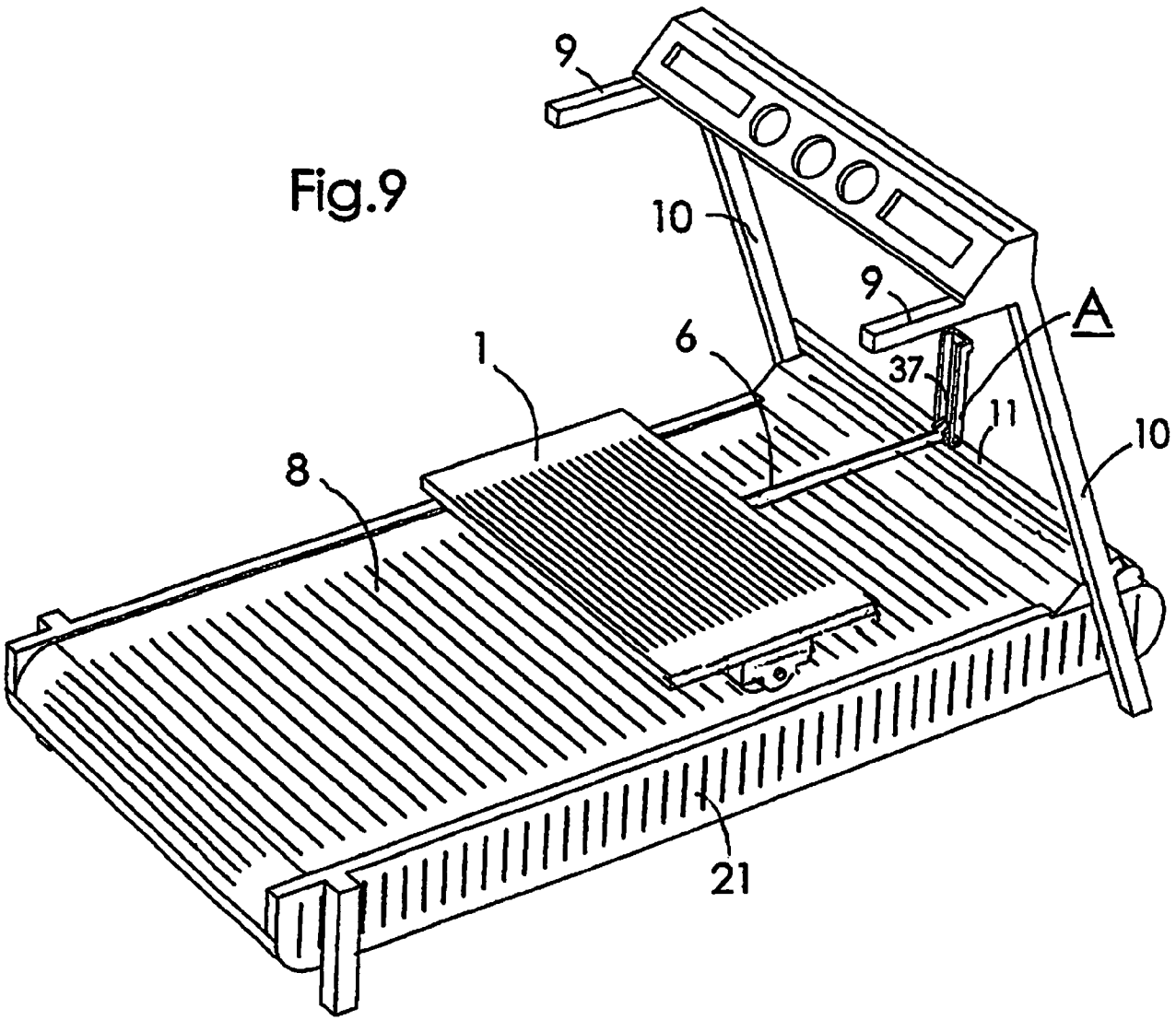
FIG. 9 shows a treadmill-vibrator combination in which a stowaway feature is shown. This enables the platform-roller combination to be stowed away so that the treadmill can be used in its normal way.
Figures 12, 12A:
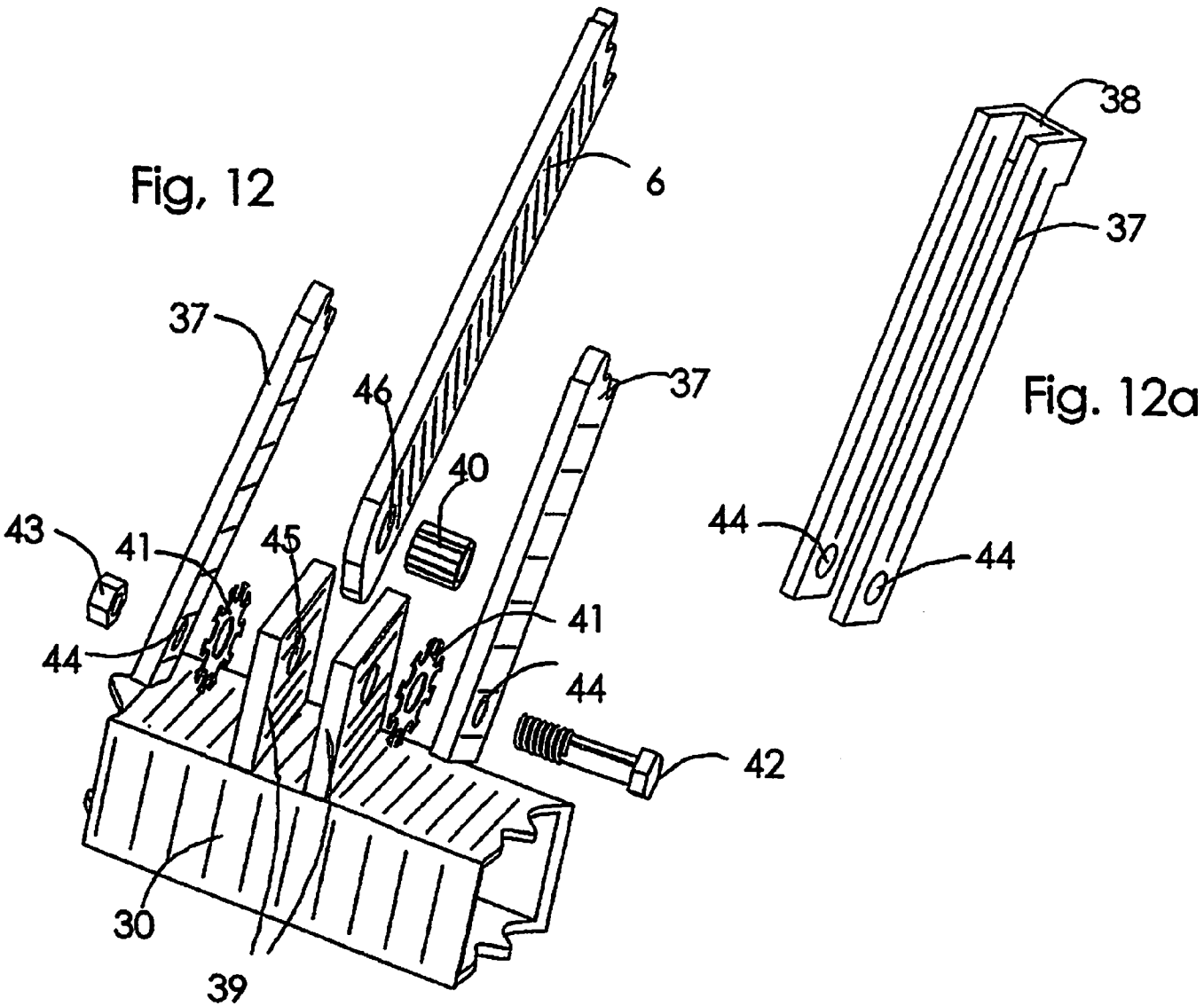
FIG. 12 shows the stowaway mechanism expanded in greater detail.
Figure 13:
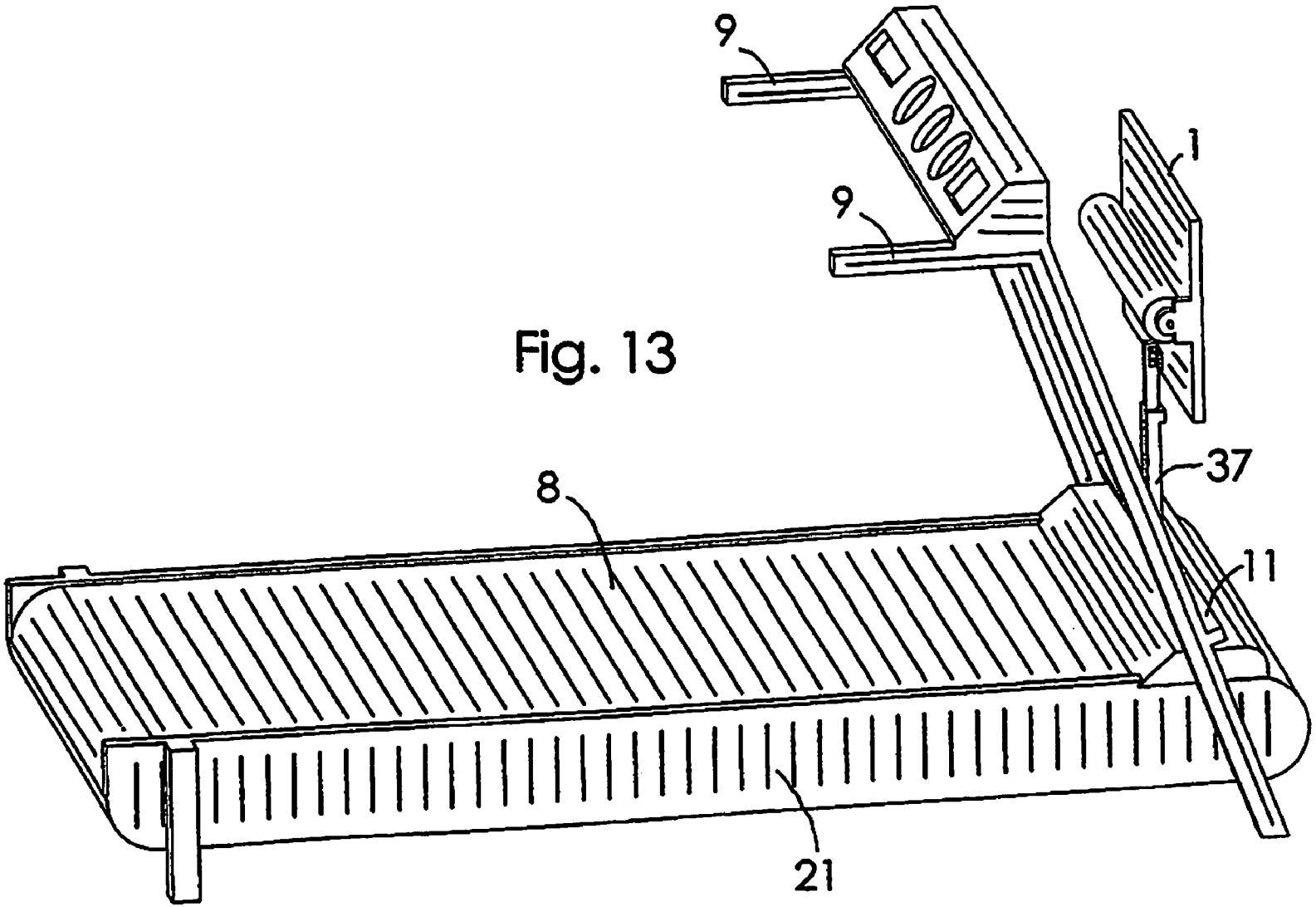
FIG. 13 shows the platform-roller combination stowed away.

The system for employing the vibrator further includes a linkage 6 connecting the platform 1 to the frame 10 of the treadmill 21 via support bar 11. Support bar 11 may be a simple bar as shown in FIGS. 3, 9 and 13, to be used in cases where the vibrator is to be installed permanently on an OEM product, or it can be an adjustable combination of parts 30 and 35 etc as described in detail in FIGS. 10, 11 and 12. Linkage 6 preferably provides longitudinal stiffness to localize the platform on the belt and restrict longitudinal movement of the platform with respect to the belt but lateral flexibility when the vibrator roller 2 is positioned on the treadmill 21. Such lateral flexibility allows the roller 2 to self-align with respect to the belt 8. The connection point between the linkage 6 and the platform 1. provided by connection bracket 5 should be sufficiently forward of the roller 2 so as to suppress undue lateral oscillations of the platform 1.

Figure 2:
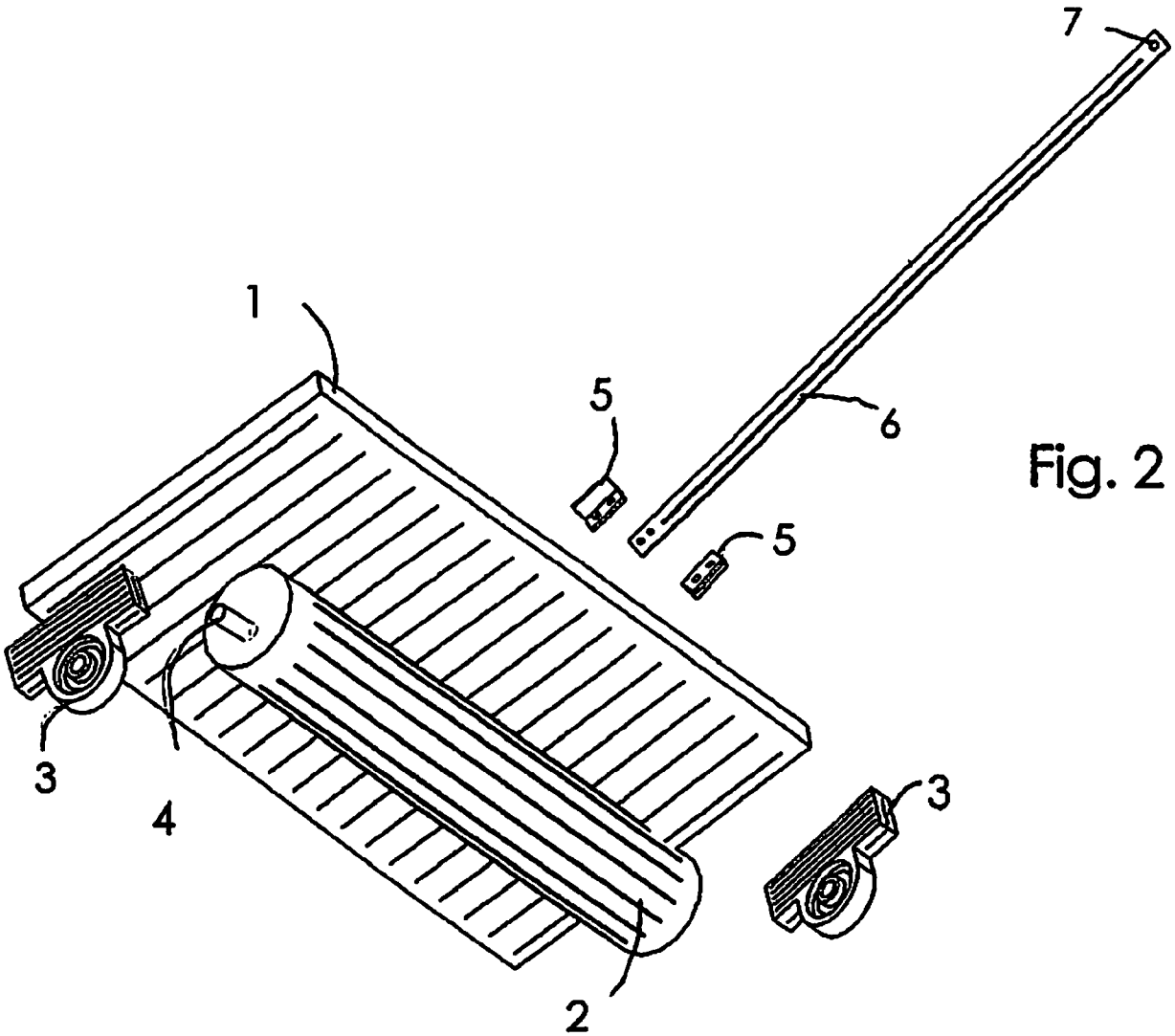
FIG. 2 is an exploded view of FIG. 1

As shown in FIGS. 1 and 2, linkage 6 may be in the form of a strip of a flexible but stiff material such as spring steel or durable, resilient plastic connected at one end to the platform 1 via brackets 5 and connected at its other end to the frame 10 of the treadmill 21 with a bolt (shown in detail in FIGS. 10, 11 and 12) passing through hole 7 and a second set of brackets 39.

During operation, the vibrator 20 is placed in position on the belt 8 of treadmill 21. A user then climbs on top of platform 1 of the device while using handles 9 to maintain their balance. The user may then activate the belt 8 of the treadmill 21 just as they would if the treadmill were to be used for walking or running. The motion of the belt 8 then frictionally drives and rotates the roller 2 while any longitudinal movement of platform 20 is restricted through the linkage 6.

As the roller 2 rotates under the force of belt 8, the eccentrically positioned roller moving eccentrically with respect to the shaft ends 4, imparts vertical oscillatory motion to the ends of the platform 1 as well as a limited horizontal oscillatory movement. The speed of the belt 8 determines the frequency of the oscillation and the user, standing atop the platform 1, is vibrated within this frequency. The user may continue to use handles 9 to maintain balance and may adjust the speed of belt 8 to produce a desired frequency of vibration. In other words, because of the eccentricity of the shaft through the roller, or the protruding shaft ends 24, the motion of platform 1 also has partial horizontal rotary motion as well as up and down motion. The position of the user's feet on the platform determines the amplitude of oscillation experienced by the user. The further apart the user's feet are, the larger the amplitude of oscillation.

Figure 4:
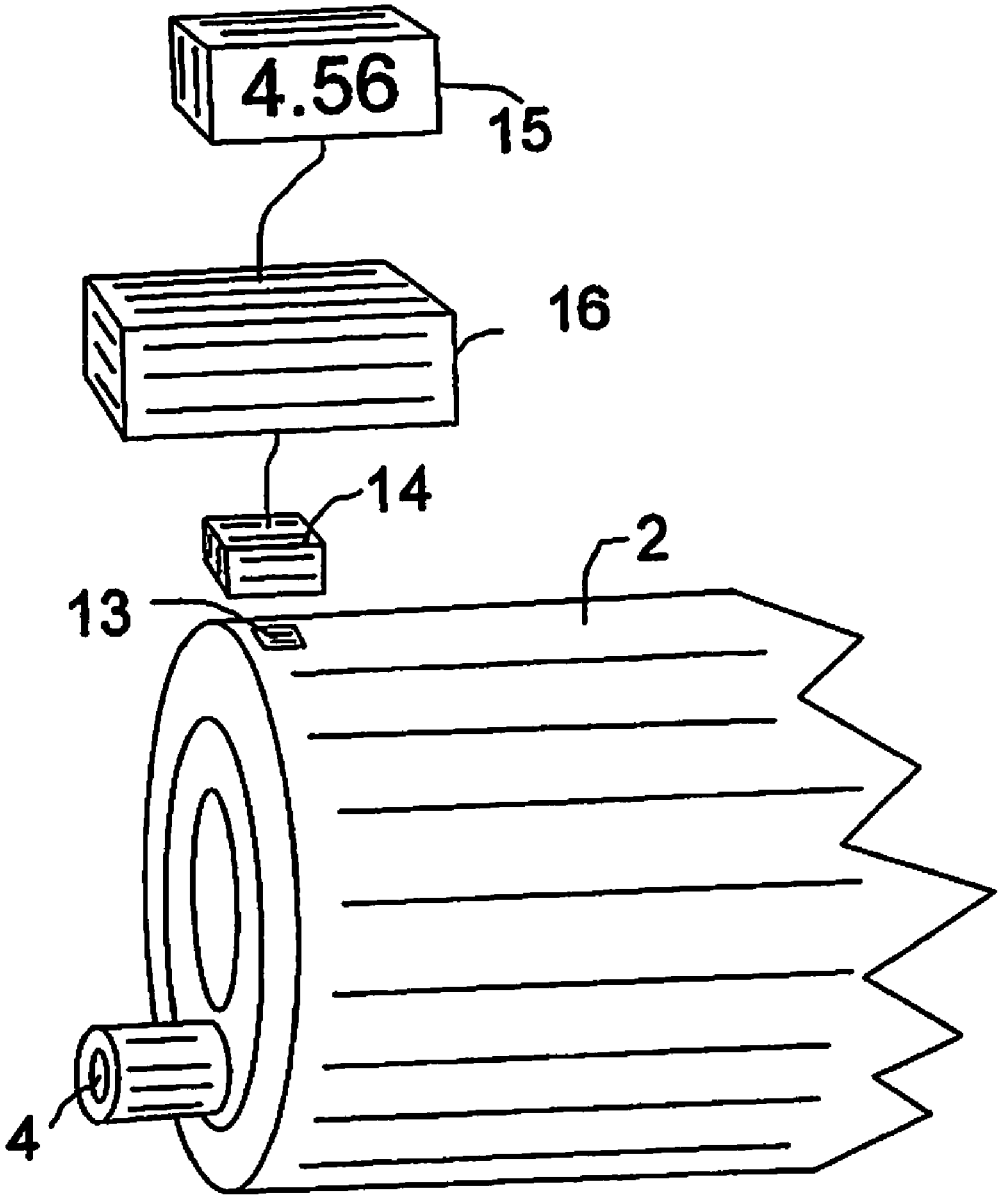
FIG. 4 shows an arrangement where a magnet attached to the roller, a sensor and a display is arranged to display relevant information to a user.

The whole body vibrator 20 may be provided with a means to display useful information such as the frequency of vibration, the rate of rotation of the roller 2, or other such information to a user. This information may be measured with the arrangement shown in FIG. 4. Here a magnet 13 fixed to the roller 2 rotates with the roller 2 and, through its magnetic flux, induces a signal in a magnetic sensor 14 positioned either on the platform 1 or bearing housing 3. Every time the roller 2 completes a rotation, the sensor 14 produces an electrical signal and delivers it to decoder 16. The decoder 16 then processes the input and provides a display 15 with a signal such that relevant information such as frequency, rotational speed, or the duration of vibration may be displayed to the user. Other optical or contact based tachometers may be alternatively used to make similar measurements and provide a signal to the display 15.

Another possible modification includes cladding the roller 2 with a resilient layer, such as a sleeve 23, as shown in FIG. 5. The resilient sleeve 23 acts as a cushion to minimize noise and to distribute the load more evenly on the belt 8 and the belt substrate of the treadmill 21. It also serves to increase the friction present between the roller 2 and the belt 8 and reduce slipping while the belt 8 drives the roller 2.

Figure 8:
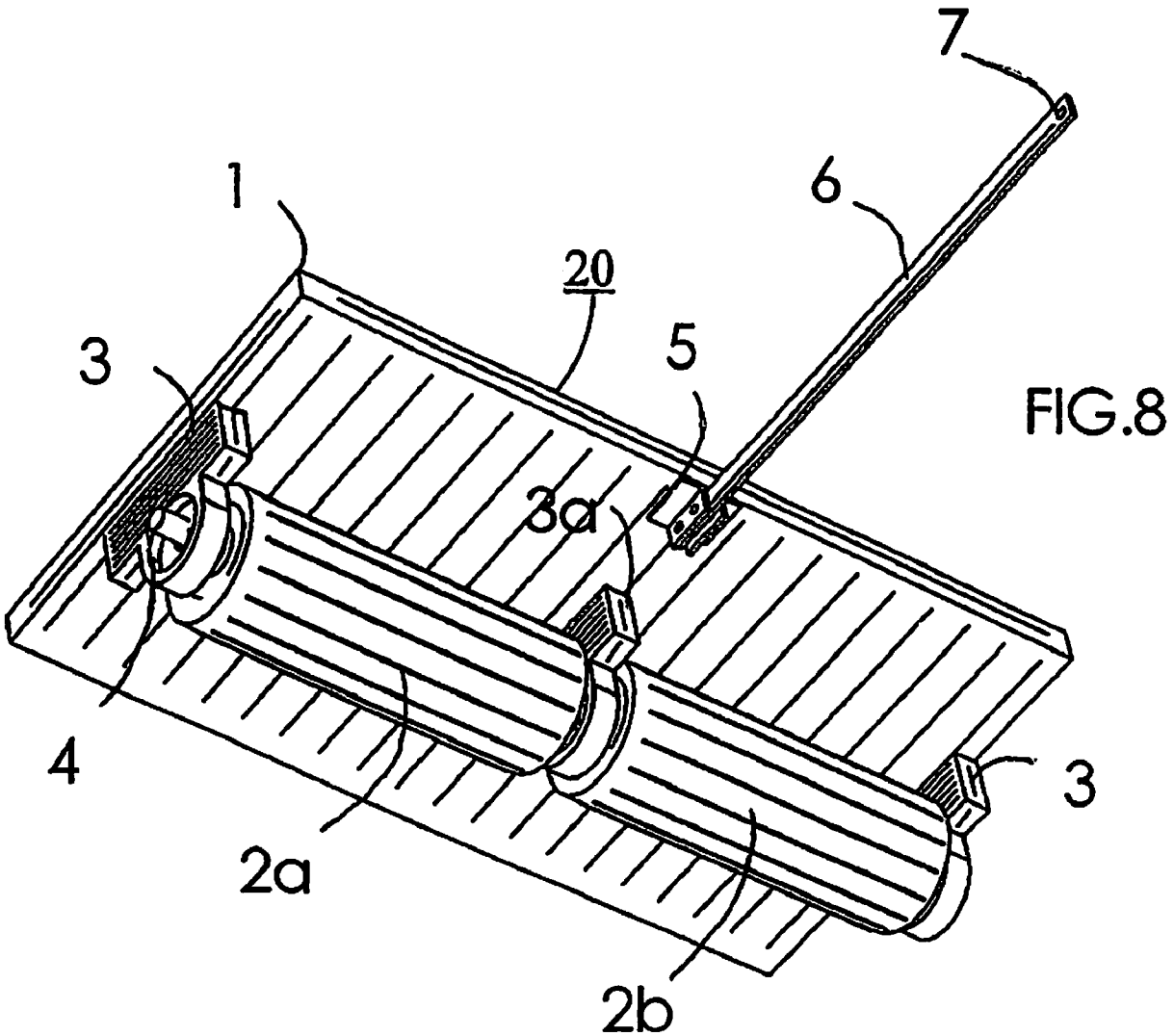
FIG. 8 shows the same arrangement as that of FIG. 1 but instead of having one single roller, it has two rollers which are fixed to the shaft so that they roll together.

Another arrangement is shown in FIG. 8. For better loading pressure on the belt, we can use two rollers coupled together on a single shaft. The two rollers are fixed together on shaft 4 and they are arranged so that shaft 4 enters the center of roller 2*a* and comes out at the other end off center. The same holds for roller 2*b*. The two rollers are fixed to shaft 4 so that their eccentricity is 180 degrees out of phase, thus simulating the same arrangement as if they were one long roller as before. A central bearing support 3*a* may extend between the lower side of the platform 1 and the center of shaft 4 as shown in FIG. 8.

FIG. 9 shows the treadmill of FIG. 3 with the addition of a bracket 37. This bracket is used for stowing away the platform 20 when the treadmill is used for walking or running. (Bracket 37 and the mechanism which the bracket and linkage 6 is described further in FIGS. 10, 11 and 12).

FIG. 13 shows the same drawing as that of FIG. 9 with the platform shown in stowaway position. To understand the stowaway mechanism and the adjustable support bar see FIG. 10, FIG. 11 and FIG. 12.

Figure 10:
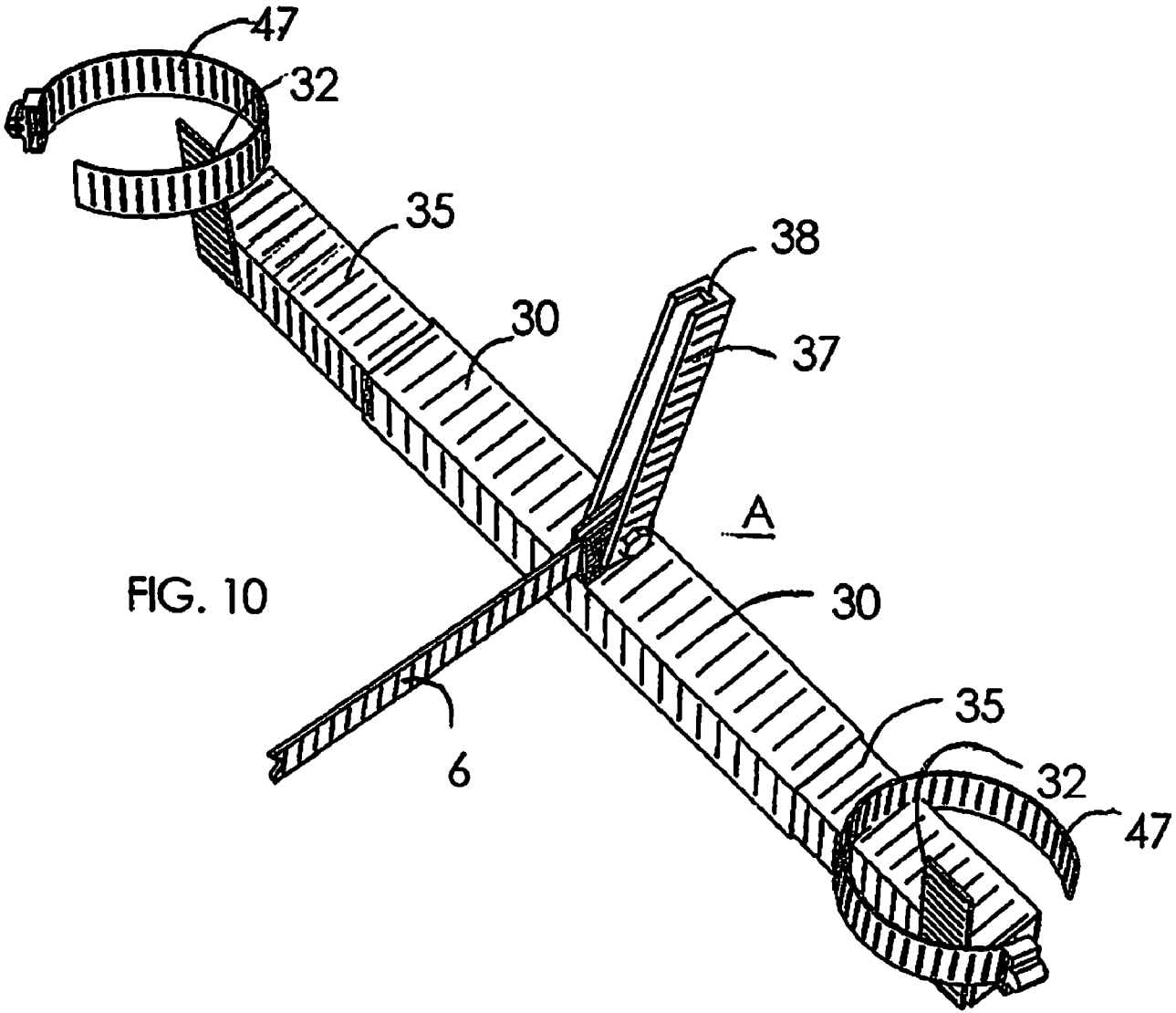
FIG. 10 shows the stowaway mechanism expanded including two clamps used to attach the adjustable support bar 30, 35 on the treadmill.
Figure 11:
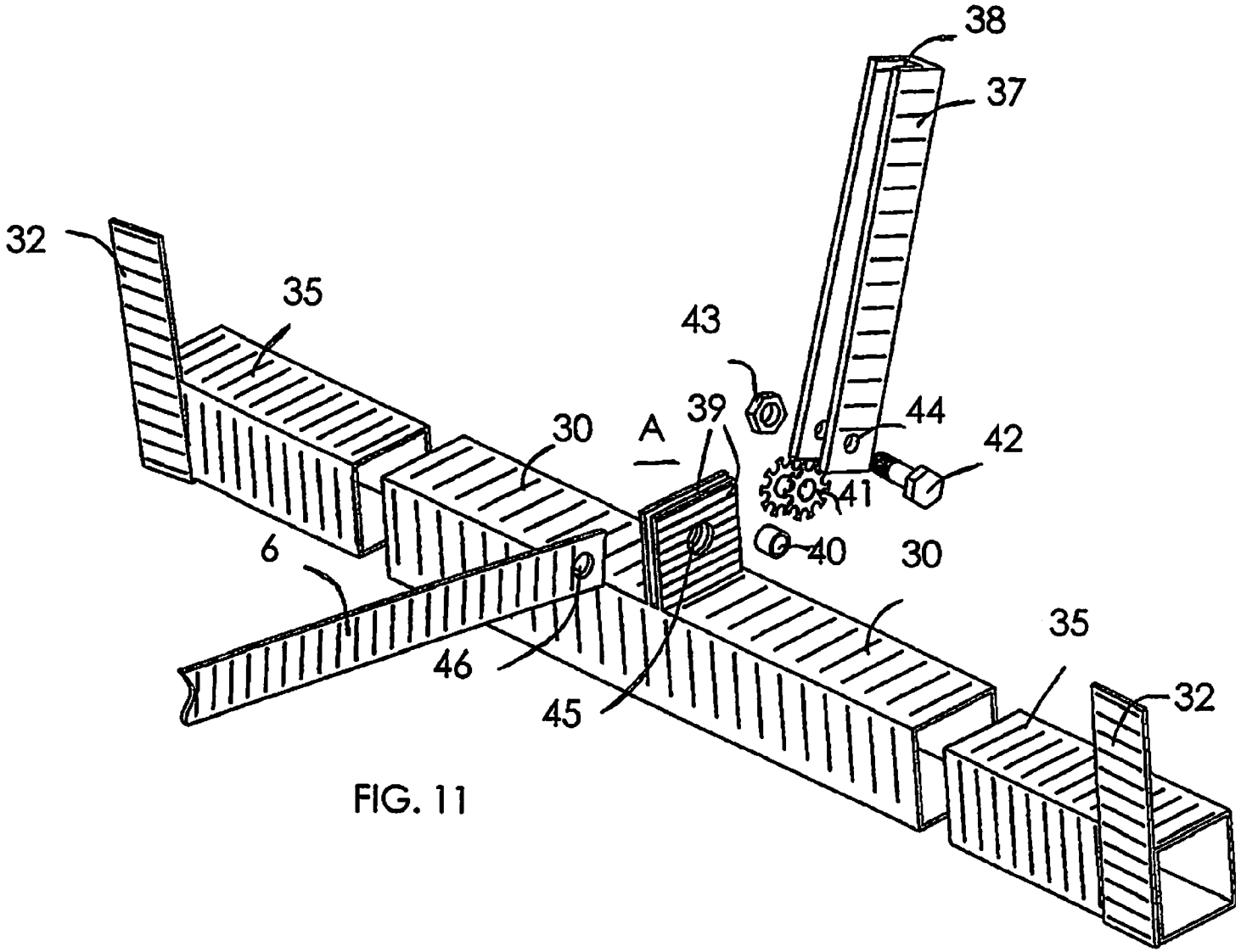
FIG. 11 shows how the stowaway mechanism is assembled to make the angle of the part that supports the flexible tether bar adjustable.

In FIG. 10, parts 35 and 30 make up the expandable support bar. The expandable support bar is used instead of the fixed support bar 11 when the vibrator is made to fit different treadmills that may have different spacing between the treadmill arms 10 tubing 35 are square cross-section tubes that fit into square cross-section tube 30 and form a telescopic arrangement of which the overall length can be adjusted. Flanges 32 are flat members which are attached to the ends of members 35. The function of flange members 32 is to enable attachment of the expandable support bar to the members 10 of a treadmill via clamps 47. As shown in FIG. 10, FIG. 11 and FIG. 12, these drawings show more clearly the mechanism A by which link 6 is free to swing upwards and at the same time, support member 37 can be adjusted at any angle with respect to the vertical position depending on the treadmill's angle of members 10 (FIG. 9).

The stowaway mechanism works as follows. Referring to FIGS. 10, 11 and 12, bracket 37 features two prongs which at one end have holes 44. Holes 44 have clearance for bolt 42 to go through. The same is true for holes 45 on brackets 39. Brackets 39 are spaced apart so that bar 6 can fit between them. Item 40 is a sleeve which has an outside diameter so that it fits with clearance through hole 46 on linkage 6. The length of sleeve 40 is the same as the distance between brackets 39. Sleeve 40 does not pass through holes 45 on brackets 39. Referring to FIG. 12 showing the stowaway mechanism when assembled, bolt 42 goes through one side of bracket 37, through lock washer 41, through one side of bracket 39, and through sleeve 40 which is fitted in hole 46 of linkage 6. Bolt 42 then goes through the other side of bracket 45, through the other lock washer 41, through the other hole of bracket 37 and, finally, is attached to nut 43.

By tightening nut 43 on bolt 42, bracket 37 is squeezed against brackets 39 and lock washers 41 provide friction so that bracket 37 becomes fixed at any position but, at the same time, linkage 6 is free to rotate around sleeve 40. FIG. 12*a* shows the complete bracket 37. Item 38 is a bridge connecting the two prongs of part 37 together.

Item 38 also provides a resting spot for linkage 6 when in stowed position.

In operation, bracket 37 is set to an angle past the vertical position so that when the platform 1 is in stowed position, it will stay up due to gravity. See FIG. 13.

Figure 14:
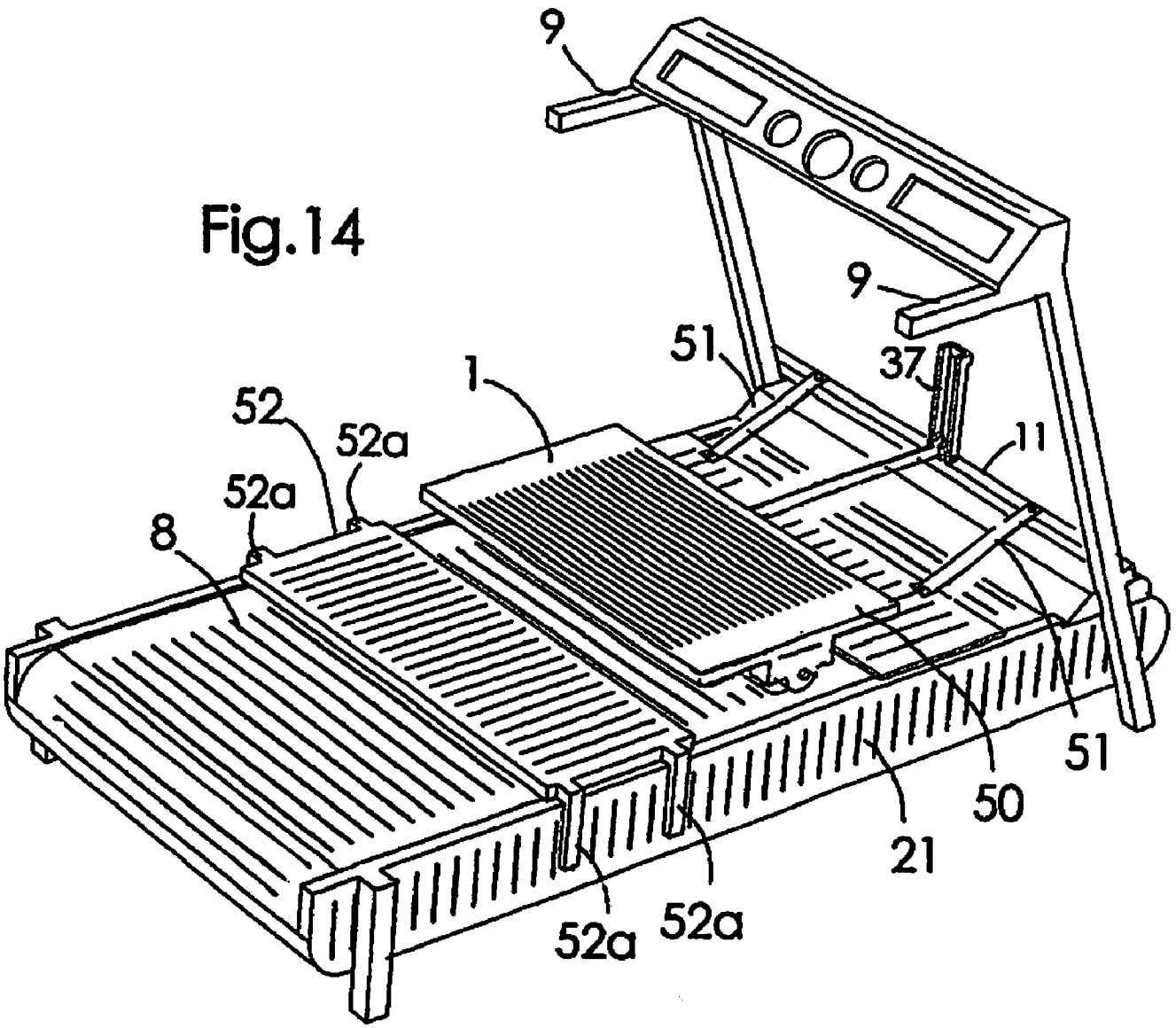
FIG. 14 shows the vibrator on a treadmill including two safety platforms 50 and 52 which prevent a user from accidentally stepping on the belt and hurting himself or herself.

FIG. 14 shows the treadmill-vibrator combination of FIG. 9 with the addition of safety panels 50 and 52. The purpose of these panels is to prevent a user on the belt while he or she is operating the vibrator. The front panel 50 is tethered on the support bar 11 (or the equivalent tube 30) via flexible straps 51. The rear panel 52 may be just placed in position and removably fixed by some means like clamps or screws (not shown). Bars 52*a* attached to rear panel 52 prevent the panel from drifting out of place. Both of the panels are lifted or held off the belt because they are supported at the ends of the treadmill which are elevated from the belt.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed are as follows:

1. In combination with a treadmill having a frame and a moving belt, a whole body vibrator for attachment to the treadmill whereby the linear motion of the belt of the treadmill is converted to a vibratory motion, the whole body vibrator comprising:

a platform on which a user may stand;

a roller for contacting the belt of a treadmill wherein the roller comprises at its respective outer ends two eccentrically protruding shaft ends which respectively support the platform on opposite sides of the platform;

bearings present between the roller and said platform to permit the roller to rotate with respect to the platform and cause the shaft ends to, in opposite phase to each other, elevate and lower the respective sides of the platform to which they are coupled; and a linkage connecting the platform to the treadmill to localize the platform on the belt and restrict longitudinal movement of the platform with respect to the belt, whereby, when the whole body vibrator is placed on the treadmill belt, the advancement of the treadmill belt will cause the platform to effect an oscillating motion suited to provide a user, whose feet are positioned on the platform, with a whole body vibrator experience.

2. The treadmill and whole body vibrator combination as described in claim 1 wherein the roller is carried by an eccentrically positioned axle shaft extending through the roller to provide the eccentrically protruding shaft ends.

3. The treadmill and whole body vibrator combination as described in claim 1 wherein the roller has outer ends and the eccentrically positioned shaft ends which protrude from each of the respective ends of the roller are fixed to the outer ends of the roller.

4. The treadmill and whole body vibrator combination as described in claim 1 wherein the linkage is longitudinally stiff but laterally flexible.

5. The treadmill and whole body vibrator combination as described in claim 1 comprising a resilient layer extending over the portion of the surface of the roller that contacts the belt to better distribute the weight of the platform and corresponding pressure on the surface of the belt and to reduce noise.

6. The treadmill and whole body vibrator combination as described in claim 1 comprising:

a magnetic element mounted on the roller, a sensor for detecting the presence of the magnetic element, the sensor being carried by the platform at a position to detect the magnetic element as it rotates past the sensor, a display controller connected to the sensor for generating a signal proportional to the rotational velocity of the roller, and a display connected to the display controller to receive the signal for providing an indication based upon the rotational velocity of the roller whereby a user will be provided with a presentation corresponding to the frequency of oscillation of the platform.

7. The treadmill and whole body vibrator combination as described in claim 1 wherein the roller comprises two roller portions, both attached to a single shaft.

8. The treadmill and whole body vibrator combination as described in claim 1 wherein the treadmill has a stowaway mechanism, and wherein the linkage is connected to the frame of the treadmill through a hinge for stowing the said platform away from said treadmill belt so that the treadmill can be freed for use in walking or running.

9. The treadmill and whole body vibrator combination as described in claim 8 in which the stowaway mechanism comprises an adjustable support member for resting the platform when in stowaway position, wherein said adjustable support member is carried by the treadmill frame and adjustable in its vertical position to permit stowing of the platform at various locations.

10. The treadmill and whole body vibrator combination as described in claim 1 in combination with one or more safety panels positioned over the belt of the treadmill to prevent a user stepping on the belt while he or she is operating the vibrator.

11. The treadmill and whole body vibrator combination as described in claim 10 wherein one of said one or more safety panels is positioned forwardly of the vibrator platform with respect to the motion of the belt to provide a front safety panel, the front safety panel being tethered through linkages to the frame of the treadmill.

12. The treadmill and whole body vibrator combination as described in claim 10 wherein one of said one or more safety panels is positioned rearwardly of the vibrator platform with respect to the motion of the belt to provide a rear safety panel, the rear safety panel comprising connectors for detachably engaging the rear safety panel to a portion of the frame of the treadmill and thereby prevent the rear panel from drifting out of place while the whole body vibrator is in use.

13. The treadmill and whole body vibrator combination as described in claim 2 in combination with one or more safety panels positioned over the belt of the treadmill to prevent a user stepping on the belt while he or she is operating the vibrator.

14. The treadmill and whole body vibrator combination as described in claim 13 wherein one of said one or more safety panels is positioned forwardly of the vibrator platform with respect to the motion of the belt to provide a front safety panel, the front safety panel being tethered through linkages to the frame of the treadmill.

15. The treadmill and whole body vibrator combination as described in claim 13 wherein one of said one or more safety panels is positioned rearwardly of the vibrator platform with respect to the motion of the belt to provide a rear safety panel, the rear safety panel comprising connectors for detachably engaging the rear safety panel to a portion of the frame of the treadmill and thereby prevent the rear panel from drifting out of place while the whole body vibrator is in use.

16. The treadmill and whole body vibrator combination as described in claim 3 in combination with one or more safety panels positioned over the belt of the treadmill to prevent a user stepping on the belt while he or she is operating the vibrator.

17. The treadmill and whole body vibrator combination as described in claim 16 wherein one of said one or more safety panels is positioned forwardly of the vibrator platform with respect to the motion of the belt to provide a front safety panel, the front safety panel being tethered through linkages to the frame of the treadmill.

18. The treadmill and whole body vibrator combination as described in claim 16 wherein one of said one or more safety panels is positioned rearwardly of the vibrator platform with respect to the motion of the belt to provide a rear safety panel, the rear safety panel comprising connectors for detachably engaging the rear safety panel to a portion of the frame of the treadmill and thereby prevent the rear panel from drifting out of place while the whole body vibrator is in use.

19. The whole body vibrator as described in claim 2 wherein the treadmill has a stowaway mechanism and wherein the linkage is connected to the frame of the treadmill through a hinge for stowing the said platform away from said treadmill belt so that the treadmill can be freed for use in walking or running.

20. The whole body vibrator as described in claim 3 wherein the treadmill has a stowaway mechanism and wherein the linkage is connected to the frame of the treadmill through a hinge for stowing the said platform away from said treadmill belt so that the treadmill can be freed for use in walking or running.

* * * * *